US007896989B1

(12) United States Patent
Fair et al.

(10) Patent No.: US 7,896,989 B1
(45) Date of Patent: Mar. 1, 2011

(54) CROSS-SECTIONAL FUNCTIONALLY GRADED PROPELLANTS AND METHOD OF MANUFACTURE

(75) Inventors: David Fair, Parsippany, NJ (US); Dilhan M. Kalyon, Teaneck, NJ (US); Sam Moy, Parsippany, NJ (US); Leon R. Manole, Great Meadows, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 295 days.

(21) Appl. No.: 10/906,274

(22) Filed: Feb. 11, 2005

Related U.S. Application Data

(60) Provisional application No. 60/521,055, filed on Feb. 12, 2004.

(51) Int. Cl.

| | |
|---|---|
| ***C06B 45/00*** | (2006.01) |
| ***C06B 45/04*** | (2006.01) |
| ***C06B 45/06*** | (2006.01) |
| ***D03D 23/00*** | (2006.01) |
| ***D03D 43/00*** | (2006.01) |

(52) U.S. Cl. ..... 149/109.6; 149/2; 149/17; 149/18; 149/109.4

(58) Field of Classification Search ..... 149/109.6, 149/2, 17, 18, 109.4

See application file for complete search history.

(56) References Cited

U.S. PATENT DOCUMENTS 5,009,728 A * 4/1991 Chan et al. ..... 149/19.1
6,689,470 B1 * 2/2004 Joseph ..... 428/408
2002/0144759 A1 * 10/2002 Walsh ..... 149/19.7

OTHER PUBLICATIONS

Kaylon et al.; "Rheological behavior of a concentrated suspension: A solid rocket fuel simulant"; Aug. 27, 1992; pp. 35-53.*

Abbott et al.; "Experimental observations of particle migration in concentrated suspensions: Couette flow"' Mar. 5, 1991; pp. 773-795.*

B.Horman et al.., "BNMO/NMMO/RDX TPE Propellant Performance As a Function of Nitramine Particle Size and Solids Loading"; US Army Research Laboratory Report; ARL-TR-2624; Dec. 2001.

Graham et al., "Processing-Induced Migration, Size Segregation, and Structure Formation in Solid Propellants"; PL-TR-92-3013; Final Report; Los Alamos National Laboratory; Los Alamos. NM 87545: Apr. 1992.

(Continued)

*Primary Examiner*—James E McDonough
(74) *Attorney, Agent, or Firm*—Henry S. Goldfine

(57) ABSTRACT

Methods of making cross sectional, functionally-graded munitions propellants exhibiting various distributions of particle concentrations and burn rate, including having a fast burning core and slower burning outer layer(s). Unlike prior art methods of preparing such munitions, propellants prepared according to our inventive method(s) may be performed substantially as a single extrusion step or as a few processing steps, without requiring the time, expense and/or difficulties that characterized familiar, laminating methods and methods which use multiple extruders. Our inventive method advantageously employs a demixing phenomenon that, prior to our inventive application and teaching, has been considered quite undesirable in the preparation of propellants where uniformity and well-mixedness have been propellant attributes widely sought after.

22 Claims, 11 Drawing Sheets

OTHER PUBLICATIONS

G.Segere and A.Silberberg; "Radial Particle Displacements in Poissuille Flow of Suspensions"; Nature; vol. 189, pp. 209-210, 1961.
H.L.Goldsmith and S.G.Mason; "Axial Migration of Particles in Poisseuille Flow"; Nature; vol. 190, pp. 1095-1096, 1961.
F.Gadala-Maria et al., "Shear-Induced Structure in a Concentrated Suspension of Solid Spheres"; J.Rheol., vol. 24, pp. 799-814, 1980.
D.Leighton and A.Acrivos; "The Shear-Induced Migration of Particles in Concentrated Suspensions"; J.Fluld Mech., vol. 181, pp. 415-439, 1987.
J.R.Abbot et al., "Experimental Observations of Particle Migration in Concentrated Suspensions:Couette Flow"; J.Rheol., vol. 35, pp. 773-795, 1981.
A.Karnis et al., The Kinetics of Flowing Dispersions I. Concentrated Suspensions of Rigid Particles; J.Colloid Interface Science, vol. 22, pp. 531-553, 1966.
C.J.Koh, et al., "An Experimental Investigation of Concentrated Suspension Flows in a Rectangular Channel"; J.Fluid Mech., vol. 266, pp. 1-32, 1994.
M.Allende and D.Kalyon, "Assessment of Particle-Migration Effects in Pressure-Driven Viscometric Flows"; J.Rheology, vol. 44, 1, pp. 79-90, 2000.
Phillips et al., "A Constitutive Equation for Concentrated Suspensions That Accounts for Shear-Induced Particle Migration"; Phys. Fluids, vol. 4., pp. 30-40, 1992.
I.M.Krieger, "Rheology of Monodisperse Lattices", Adv. Colloid Interface Sci., vol. 3, pp. 111-136, 1972.
M.Alende, "Shear Induced Particle Migration in Suspensions of Non-Colloidal Particles", Ph.D. Dissertation, Stevens Institute of Technology, Hoboken, NJ 2000.
Yilmazer et al., "Slip Effects in Capillary and Parallel Disk Torsional Flows of Highly Filled Suspensions", J.Rheol. vol. 33, pp. 1197-1212, 1989.
Kalyon et al., "Rheological Behaviour of a Concentrated Suspension: A Solid Rocket Fuel Simulant"; J.Rheol. vol. 37, pp. 35-53, 1993.
D.M.Kalyon, "Effects of Temperature and Surface Roughness on Time-Dependent Development of Wall Slip in Steady Torsional Flow of Concentrated Suspension", J. Rheol. vol. 38. pp. 957-972. 1994.
Yilmazer et al.., "Slip Effects in Capillary and Parallel Disk Torsional Flows of Highly Filled Suspensions", J.Rheol., vol. 22, pp. 1197-1212, 1989.

* cited by examiner

200

CROSS-SECTIONAL FUNCTIONALLY GRADED PROPELLANTS AND METHOD OF MANUFACTURE

CROSS REFERENCE TO RELATED APPLICATION

This application claims the benefit under 35 USC 119(e) of U.S. Provisional Patent Application No. 60/521,055 filed Feb. 12, 2004, the entire file wrapper contents of which provisional application are herein incorporated by reference as though set forth at length.

FEDERAL RESEARCH STATEMENT

The invention described herein may be made, used, or licensed by or for the United States Government for government purposes without payment of any royalties thereon or therefore.

BACKGROUND OF THE INVENTION

1. Field of the Invention

This invention relates generally to the field of munitions propellants and in particular it relates to propellants that are functionally-graded over their cross-sectional areas and corresponding method of manufacture in which individual grains of the munitions propellant have particle concentration, and hence burn rate distributions, including a fast burning core and slower burning outer region(s).

2. Description of Related Art

Recently, significant interest has been expressed in the use of "fast core" and/or "plateau burning" munitions propellants as one way to improve the performance of munitions. At present, such fast core propellants are propellants prepared using two separate propellant formulations. A first, fast burning propellant formulation forms the center or "core" of individual propellant grains, and a second, slower burning propellant formulation forms the outer layer(s) of the individual propellant grains. When constructed in this manner, the outer layers burn more slowly than the faster burning core.

The construction of such propellants is facilitated by the knowledge that the changes in concentration of energetic particles that comprise energetic propellants will change the burn rate. For example, the experimental work of B. Homan, D. Devynck, P. Kaste, R. Lieb, D. Bullock and A. Juhasz that was described in a paper entitled "BNMO/NMMO/RDX TPE Propellant Performance as a function of nitramine particle size and solids loading"; published in the US Army Research Laboratory Report, ARL-TR-2624 in December 2001 disclosed that the burn rate of an energetic suspension is a function of the concentration of energetic particles and their size(s). FIG. 1 shows the selected results of this study wherein the concentration of RDX particles increases the burn rate across the entire range of particle sizes considered in the 2 to 32 micron size range.

In an attempt to explore the improvement(s) and thereby improve the ballistic performance of guns, multi-layer munitions propellants having a fast burning propellant formulation sandwiched between slower burning propellant formulations (cross-sectional, functionally graded propellants) have been prepared. Unfortunately, while these munitions propellant "laminates" are based upon sound theory and offer much promise, they have proven extremely difficult and quite costly to make.

Accordingly, new methods that facilitate and/or permit the preparation of a cross-sectional, functionally graded munitions propellants exhibiting a continuum of burn characteristics—i.e., from slow to fast—are highly desirable and if provided in a reproducible, cost effective and convenient manner—would represent great progress in the art.

Seemingly unrelated studies in the field of rocket motor design and construction as well as other theoretical/experimental undertakings has led to certain knowledge of solid phase migration that takes place during processing of solid rocket motor propellants. In particular, it was experimentally observed that particles in a concentrated suspension subjected to inhomogeneous shear fields rapidly migrate away from regions of high shear rate in inhomogeneous shear fields and develop anisotropic particle structures. More specifically, in a bimodal suspension such as a rocket motor propellant, coarse fraction(s) migrate much faster than the fine fraction (s), which leads to size segregation of initially, well-mixed suspensions. (See, e.g., Alan L. Graham, "PROCESSING-INDUCED MIGRATION, SIZE SEGREGATION, AND STRUCTURE FORMATION IN SOLID PROPELLANTS", PL-TR-92-3013; Final Report; Los Alamos National Laboratory, Los Alamos N. Mex. 87545; April 1992.) In view of its decidedly undesirable nature in the context of solid rocket motors, the phenomenon was appropriately named, "demixing".

Despite its undesirable effect on the manufacture of solid rocket motors, we have nevertheless advantageously applied this demixing phenomenon to the design and manufacture of new types of i.e., munitions and propellants, which are functionally graded over their cross-sections and are the subject of the present invention.

SUMMARY OF THE INVENTION

We have developed a method of preparing munitions propellants which are functionally-graded over their cross-sectional areas, including having a fast burning core and slower burning outer layer(s). Unlike prior art methods of preparing such munitions propellants, our inventive method may be performed substantially as a single or relatively few processing steps, without requiring the time, expense and/or difficulties that characterized familiar, laminating methods or the use of multiple processing machinery.

Our inventive method employs the demixing phenomenon that, prior to our inventive application and teaching, has been quite undesirable in the preparation of propellants, where uniformity and well-mixed have been propellant attributes widely sought after.

According to a first embodiment of our invention, a single, bulk formulation of munitions propellant is driven under pressure through die and/or pipes of sufficient length such that propellant components are stratified by concentration producing a desirable, cross-sectional concentration gradient in the extruded propellant. The resulting cross-sectional, functionally graded propellant advantageously exhibits a faster burning core and a slower burning outer layer(s).

According to a second embodiment of our invention, a single, bulk formulation of munitions propellant is deformed in a space formed between two, coaxially aligned cylinders, one of which remains stationary while the other rotates. When the space (or gap) between the two cylinders is sufficiently large in comparison to the diameters of the cylinders (wide-gapped Couette flow), propellant components are stratified by concentration producing a desirable, cross-sectional concentration gradient in the propellant situated between the two cylinders. The resulting cross-sectional, functionally graded propellant advantageously exhibits one surface, which is faster burning, and a second surface, which is slower burning.

According to a third embodiment of our invention, a single, bulk formulation of munitions propellant is driven under pressure through annular dies including a rotating mandrel and a stationary bushing such that the propellant components are stratified by concentration producing a desirable, cross-sectional concentration gradient in the extruded propellant. The resulting cross-sectional, functionally graded propellant advantageously exhibits a distribution of burn rates from one of its surfaces to the other.

Additionally, our inventive method may advantageously result in a functionally graded propellant having a binder/plasticizer outer boundary that is less sensitive to initiation, thereby facilitating the further development of highly desirable, Insensitive Munitions (IM).

Lastly, our inventive method provides for the reuse of manufacturing "scrap", for thermoplastic binders, such that it may be returned to the bulk formulation and turned into finished product, rather than discarded which adds cost and raises environmental concerns, as would be the case with existing preparative method(s).

Other objects, features and advantages of the present invention will become more apparent in light of the following detailed description of a preferred embodiment thereof.

BRIEF DESCRIPTION OF THE DRAWINGS

Various features and advantages of the present invention and the manner of attaining them will be described in greater detail with reference to the following description, claims and drawing in which:

DETAILED DESCRIPTION

Figure 1:
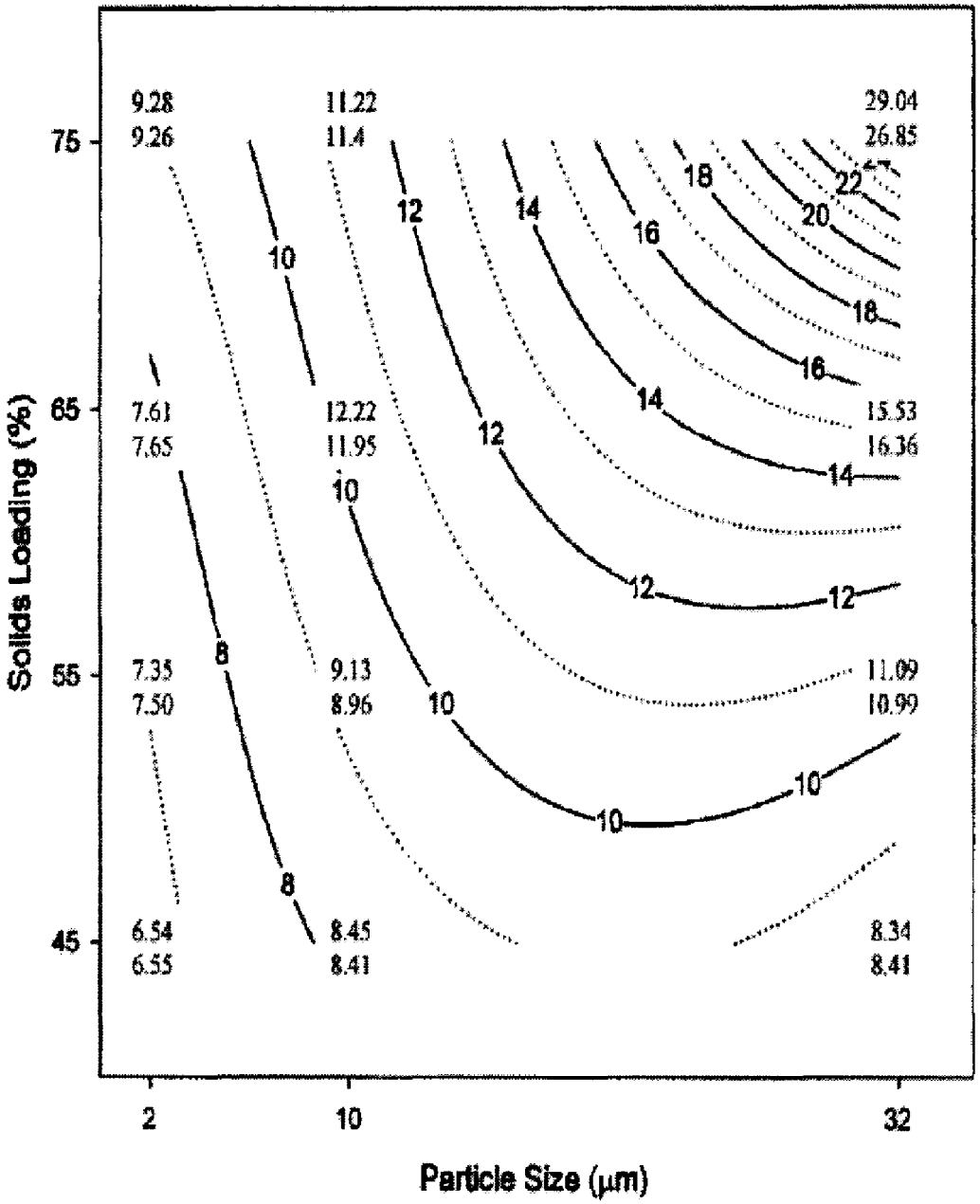
FIG. 1 is a graph illustrating the relationship between the burning rate and the particle concentration for a particular propellant formulation, as determined by the Prior Art.

As previously noted, experimental observations have been made that particles in concentrated suspensions such as certain solid-rocket motor propellants (i.e., perchlorate)—that are subjected to inhomogeneous shear fields—rapidly migrate away from regions of high shear rate in inhomogeneous shear flow fields and develop an anisotropic binder/plasticizer distribution. In certain suspensions, this leads to a particle size-segregation (demixing) as well as a concentration distribution of an initially well-mixed suspension.

In particular, it was observed that these suspensions—subjected to inhomogeneous shear in pressure driven flow through circular conduits—demixed such that the concentration of certain solids in an inner region of the suspension was higher than that in outer, annular region(s) of the suspension.

As was also noted, such particle migration was investigated for the purpose(s) of understanding it sufficiently—so that its effect could be minimized or eliminated altogether!

Theoretical Discussion of Particle Migration

Now, by way of further theoretical foundation, energetic materials such as solid rocket fuels and gun propellants are typically suspensions comprising a polymeric binder incorporated with rigid particles. The particles are generally symmetric, having low aspect ratios and broad particle size distributions thereby allowing relatively high solid packing ratios. Additionally, the concentration of the rigid particles in the energetic material needs to be relatively high, and in most cases approaches the maximum packing fraction of the solids (the characteristic concentration of the solid particles above which there is no fluidity).

In the flow and processing of such highly filled (concentrated) suspensions a number of mechanisms act to generate gradients in the concentrations of particles. Such gradients may arise, for example, during a pressure-driven Poiseuille flow (flow through circular tube dies or rectangular slit dies) wherein the binder can migrate in the axial direction i.e., flow direction. This behavior is observed especially with concentrated suspensions filled close to their maximum packing fractions and manifests itself as the filtration of the binder as a result of the imposed pressure gradient, superimposed on the bulk flow of the suspension.

Another gradient formation is observed during the migration of the non-colloidal solid particles in inhomogeneous flows of the suspension in the transverse-to-flow direction i.e., in the direction of the imposed deformation rate. When the Reynolds number is greater than $10^{-3}$ inertial effects give rise to the radial migration of solid particles (see, for example G. Segre and A. Silberberg; "Radial Particle Displacements in Poissuille Flow of Suspensions"; Nature; Vol. 189, pp. 209-210 1961; and H. L. Goldsmith and S. G. Mason; "Axial Migration Of Particles In Poisseuille Flow"; Nature; Vol. 190, pp. 1095-1096, 1961).

However, the migration of the particles, and the resulting development of particle concentration gradients in transverse-to-flow direction occur upon inhomogeneous flows even in the absence of inertial effects. Thus, they even occur during creeping flows in which the prevailing Reynolds number approaches zero. Since the shear viscosity of most energetic suspensions is very high the flow of energetic suspensions could be considered as creeping flow and is thus subject to the migration of particles even in the absence of inertial effects.

The experimental evidence to the occurrence of the particle migrations under creeping flow conditions and where gradients of deformation rates exist, was disclosed by F. Gadala-Maria and Acrivos in an article entitled "Shear-Induced Structure in A Concentrated Suspension of Solid Spheres"; which appeared in J. Rheol, Vol. 24, pp. 799-814 in 1980. In that paper, the authors disclosed that the observed shear viscosity of concentrated suspensions decreased with time in a Couette flow.

Later, D. Leighton and A. Acrivos showed, in a paper entitled "The Shear-Induced Migration Of Particles in Concentrated Suspensions" which was published in Vol 181 of J. Fluid Mech., pp. 415-439, 1987, that the observed decrease in viscosity was associated with the migration of solid particles from a high shear rate region located in between the two concentric cylinders to a low shear rate region located at the reservoir bottom of the Couette geometry.

The migration of particles from high shear rate to low shear rate in wide-gap Couette flow (where shear rate is not uniform) was further studied using magnetic resonance imaging and subsequently published in a paper entitled "Experimental Observations of Particle Migration In Concentrated Suspensions: Couette Flow", that was authored by J. R. Abbott, N. Tetlow, A. L. Graham, S. A. Altobelli, E. Fukushima, L. A. Mondy and T. S Stephens and which appeared in J. Rheol, Vol, 35, pp 773-795 in 1991.

In a pressure driven channel flow (rectangular slit and capillary) a number of investigators observed the blunting of the velocity profile (See, e.g., A. Karnis, H. L. Goldsmith and S. G. Mason, "The Kinetics of Flowing Dispersions I. Concentrated Suspensions of Rigid Particles"; J. Colloid Interface Science, Vol. 22, pp. 531-553 1966). Such blunting can be a consequence of particle concentration gradients, which were observed in channel flow and described by C. J. Koh, P. Hookham and L. G. Leal in a paper entitled "An Experimental Investigation of Concentrated Suspension Flows In a Rectangular Channel", which appeared in J. Fluid Mech., Vol 266, pp. 1-32 in 1994. Additional theoretical understanding of particle migrations in pressure-driven flows, and in particular their occurrence when the particle radius over the channel gap is relatively high, was provided by M. Allende and D. Kalyon in an article entitled "Assessment of Particle-Migration Effects In Pressure-Driven Viscometric Flows", which appeared in J. Rheology Vol. 44, 1, pp. 79-90 in 2000.

Phenomenological models of migration of neutrally-buoyant, unimodal and spherical particles suspended in Newtonian fluids, across planes of shear during inhomogeneous shear flows generally attribute the migration to irreversible interactions. By using scaling arguments, a general expression for the diffusive flux of particles in simple shear flow was derived. In particular, Phillips et al. in an article entitled "A Constitutive Equation For Concentrated Suspensions That Accounts For Shear-Induced Particle Migration," that appeared in Phys. Fluids A, Vol. 4, p. 30-40 in 1992, used flux expressions described earlier by Leighton and Acrivos (See, e.g., Leighton and Acrivos, "The Shear-Induced Migration Of Particles In Concentrated Suspensions," J. Fluid Mech. Vol. 181, pp. 415-439, 1987) to develop a diffusion equation that describes the evolution of particle concentration distributions over time. This diffusion equation assumes that there are two primary causes for particle migration, i.e., particle interactions and local variations of the concentration-dependent suspension viscosity The model disclosed by Phillips et al. in the 1992 article was further modified by using two different boundary conditions, i.e. the continuity of the flux at the axis of symmetry and the incorporation of apparent slip at the wall (wall slip is prevalent in the flow of concentrated suspensions including energetic suspensions) by M. Allende and D. Kalyon in an article entitled "Assessment of particle-Migration Effects in Pressure-Driven Viscometric Flows", which appeared in J. Rheology Vol. 44, 1, pp. 79-90 in 2000.

These papers of Acrivos and co-workers (Leighton and Acrivos) showed that there are several ways in which the irreversible interactions can lead to particle migration in the presence of concentration and shear stress gradients. In particular, consider a suspension undergoing non-homogeneous shear flow. Within the plane of shear, the shear viscosity is constant. An interaction occurs when two particles embedded in adjacent shearing surfaces move past one another. Since these interactions may cause a particle to be irreversibly moved from its original streamline, a particle which experiences a higher interaction frequency from one direction than from the opposing direction will migrate normal to shearing surface and in the direction of the lower interactions frequency. The resulting diffusion equation assumes that there are two primary causes for particle migration, i.e. gradients in collision frequency and gradients in suspension viscosity.

Still further, consider a suspension of hard spheres with radius a in a Newtonian fluid with viscosity $\eta_0$. Assume that the particles diffuse in the Newtonian liquid at shear rate, $\dot{\gamma}$, with diffusivity D and that the Peclet number $Pe=a^2\dot{\gamma}/D$, is relatively large so that Brownian motion can be neglected. The number of collisions or interactions experienced by a particle scales as $\dot{\gamma}\phi$, where $\dot{\gamma}$ is the local shear rate and $\phi$ is the particle volume fraction. The gradient in the collision frequency over a characteristic distance of O(a) is given by a $\vec{\nabla}(\dot{\gamma}\phi)$.

Therefore, the particle flux, occurring due to a gradient in collision frequency, is given by (See, e.g., Phillips et al., 1992):

$$\vec{N}_c=-K_c a^2\phi(\phi\vec{\nabla}\dot{\gamma}+\dot{\gamma}\vec{\nabla}\phi) \tag{1}$$

where $K_c$ is a proportionality constant that needs to be determined from experimental data.

The first term in Equation (1) implies that even in the absence of a gradient in particle concentration migration of particles will result based on the non-homogeneous shear flow such as Poiseuille and wide-gap Couette flows. The second term in Equation (1) states that a gradient in particle concentration will cause a spatial variation in the frequency of collisions. If a non-homogeneous shear flow is started in a suspension with a uniform concentration distribution, $\phi$, the first term in Equation (1) gives rises to a flux, which in turn generates a concentration gradient and hence induces a second flux proportional to $\vec{\nabla}\phi$.

Thus, the two terms in Equation (1) are in general in opposite directions. Particles migrate from regions of high to low shear rate, and from regions of high to low concentration.

In addition to the flux caused by gradients in collision frequency, it is possible that an interaction between two particles will be affected by a gradient in suspension viscosity caused by the presence of gradients in the particle concentration. Both particles are displaced in the direction of lower viscosity. The magnitude of this displacement during each irreversible interaction is scaled with the relative change in suspension viscosity, i.e. $(a/\eta_s)\vec{\nabla}\eta_s$.

If each interaction causes a displacement over a characteristic distance of O(a) and the interaction frequency scales as $\dot{\gamma}\phi$, then the flux $\vec{N}\eta$ due to a viscosity gradient, is given by (Phillips et al. (1992))

$$\vec{N}_\eta = -K_\eta a^2 \frac{\dot{\gamma}\phi^2}{\eta_s}\vec{\nabla}_{\eta s} \tag{2}$$

where $K_\eta$ is a diffusion constant that needs to be determined from experimental data, and $\eta_s=\eta_s(\phi)$ is the shear viscosity of the concentrated suspension. In the article authored by Phillips et al. in 1992) the authors therein provided a conservation equation for solid particles, which can be written in a Lagrangian reference frame as:

$$\frac{\partial \phi}{\partial t} + \vec{v} \cdot \vec{\nabla} \phi = -\vec{\nabla} \cdot \left(\vec{N}_c + \vec{N}_\eta\right) \tag{3}$$

Equation (3) is a shear-induced particle migration model for a concentrated suspension of unimodal spheres undergoing non-homogeneous shear flows.

This model and its subsequent modifications (See, e.g., Allende and Kalyon (2000)) provide the foundation for the calculations used herein to describe the particle migration(s) that occur under certain conditions and particle concentrations Now, turning our attention to our inventive concepts, we know that there exists a relationship between the burn rate of an energetic material and its solids loading level. Advantageously, this relationship may be expressed as:

$$\text{Burn rate} = c + b\phi + a\phi^2 \tag{4}$$

where $\phi$ is the volume fraction of energetic particles in the formulation and a, b and c are constants that depend on the particle size, particle type/geometry and the nature of the binder/particle interactions. These three parameters are best fitted from the data contained in FIG. 1.

As can be appreciated by those skilled in the art, conditions that generate energetic particle concentration distributions within energetic materials also lead to burn rate distributions within those energetic materials. And, in sharp contrast to the prior art—which toiled to eliminate such burn rate distributions—we, for the first time, advantageously employ this distribution phenomenon in the manufacture of our cross-sectional, functionally graded propellants.

Couette Flow Geometry

Figure 2:
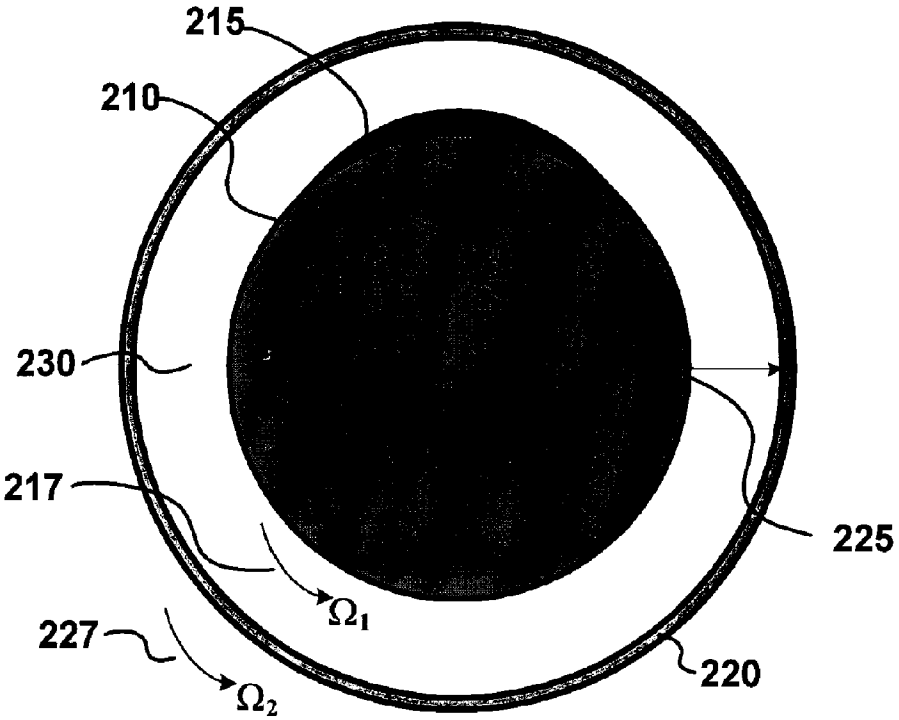
FIG. 2 is a schematic of a Couette apparatus.

With reference now to FIG. 2, there is shown a schematic of Couette apparatus 200 used in an exemplary embodiment that illustrates our inventive teachings. In particular, the schematic Couette apparatus includes two concentric cylinders 210, 220, one disposed in the other, in axial alignment. As can be observed from the schematic shown in FIG. 2, each of the two cylinders 210 and 220, has a characteristic radius $R_1$ and $R_2$, which are indicated by reference numerals 215 and 225 respectively.

Shown in FIG. 2, and as a result of the inner cylinder 210 having a radius $R_1$ 215 which is smaller than the radius $R_2$ 225 of the outer cylinder 220, a gap 230 is formed between the two cylinders. In operation, the two cylinders 210, 220 each may rotate at a characteristic angular velocity, depicted by $\Omega_1$ 217 and $\Omega_2$ 227, respectively. The simplest case is that when the outer cylinder is at rest, $\Omega_2=0$.

Now, if we consider a concentrated suspension undergoing non-homogeneous shear flow in a wide-gap Couette flow geometry such as that depicted in FIG. 2. In this FIG. 2, the non-dimensional inner cylinder radius is represented here as $\kappa$, was taken to be 0.27. The inner cylinder 210 with radius $R_1$ 215, rotates with angular velocity, $\Omega_1$ 217, and outer cylinder 220 with radius, $R_2$ 225, is stationary $\Omega_2=0$. The $\theta$-component of the equation of motion in cylindrical coordinates yields $$\frac{1}{r^2}\frac{\partial}{\partial r}(r^2 \tau_{r\theta}) = 0 \tag{5}$$

and the time-dependent evolution of the concentration profile can be obtained from the analysis for a transient Couette flow. This requires the solution of the following Equation (6) for the case $\phi=\phi(r,t)$, where r is the radial coordinate and t is time. The diffusion equation becomes:

$$\frac{\partial \phi}{\partial t} = \frac{a^2}{r}\frac{\partial}{\partial r}\left\{r\left[K_c\left(\phi^2\frac{\partial \dot{\gamma}}{\partial r} + \dot{\gamma}\phi\frac{\partial \phi}{\partial r}\right) + K_\eta \frac{\dot{\gamma}\phi^2}{\eta_s}\frac{\partial \eta_s}{\partial r}\right]\right\} \tag{6}$$

The $\theta$-component of the equation of motion (Equation 5) is solved to give an expression for the local shear rate, $\dot{\gamma}$, as a function of the concentration-dependent suspension viscosity, $\eta_s(\phi)$, which can be rendered a function of the volume fraction of the solids, $\phi$, over the maximum packing fraction. When an earlier model proposed by I. M. Krieger in an article entitled "Rheology of Monodisperse Lattices", which was published in Adv. Colloid Interface Sci., Vol. 3, pp. 111-136 in 1972, is used to express the suspension viscosity, $\eta_s(\phi)$, as a function of the concentration, $\phi$, Equation (6) is solved to give the concentration distribution $\phi=\phi(r,t)$.

Subsequently, steady state distributions of the concentration of particles in suspension were described by Allende for $K_c/K_\eta=0.66$ (See M. Alende, "SHEAR INDUCED PARTICLE MIGRATION IN SUSPENSIONS OF NON-COLLOIDAL PARTICLES," PhD. Dissertation, Stevens Institute of Technology, Hoboken, N.J. 2000).

Such calculations and analysis provide analytical insight into useful suspension characteristics as well as geometric and operating conditions for the generation of desired energetic concentration distributions and hence the production of desirable burn rate distributions within energetic materials.

Returning to our experimental set-up shown in FIG. 2, it can now be appreciated that if a concentrated suspension of energetic particles and inert or energetic binder (not specifically shown in the FIG. 2) is placed into the gap 230 between two cylinders 210 and 220—one of which 210, is rotating and the other 220, is stationary—particle concentration gradients will be established. In particular, a high concentration of rigid particles will be established along the wall of the outer stationary cylinder 220 and a relatively low concentration of particles will be established along the wall of inner, stationary cylinder 210—provided that the particle diameter over the gap ratio is sufficiently high and the rotating cylinder is rotated sufficient number of times until a steady state concentration, velocity and shear rate distributions are reached.

Figure 3:
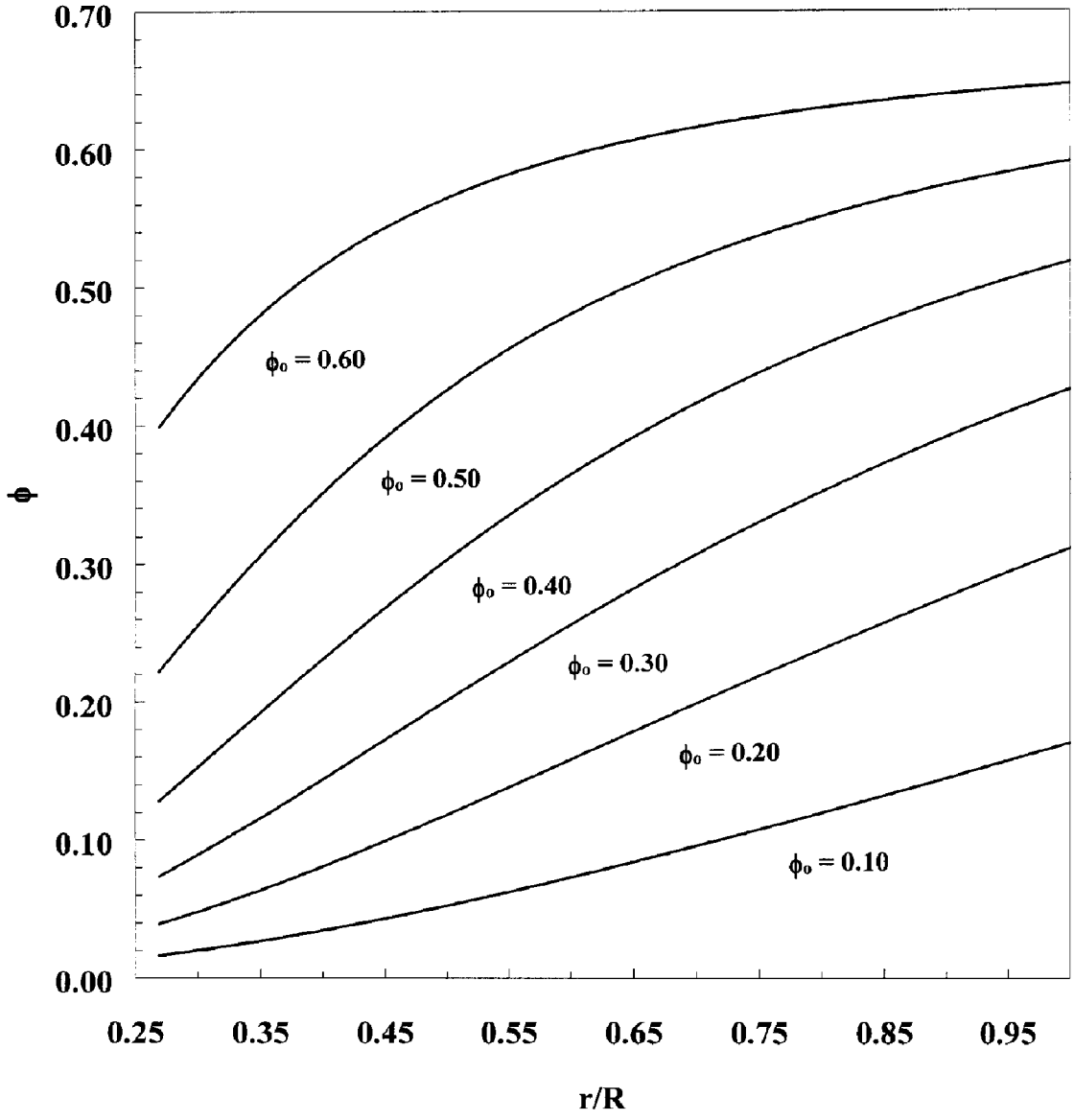
FIG. 3 shows the typical steady state concentration distributions of rigid particles for differing values of initial particle concentration and as a function of radial distance between the inner and outer cylinders.
Figure 4:
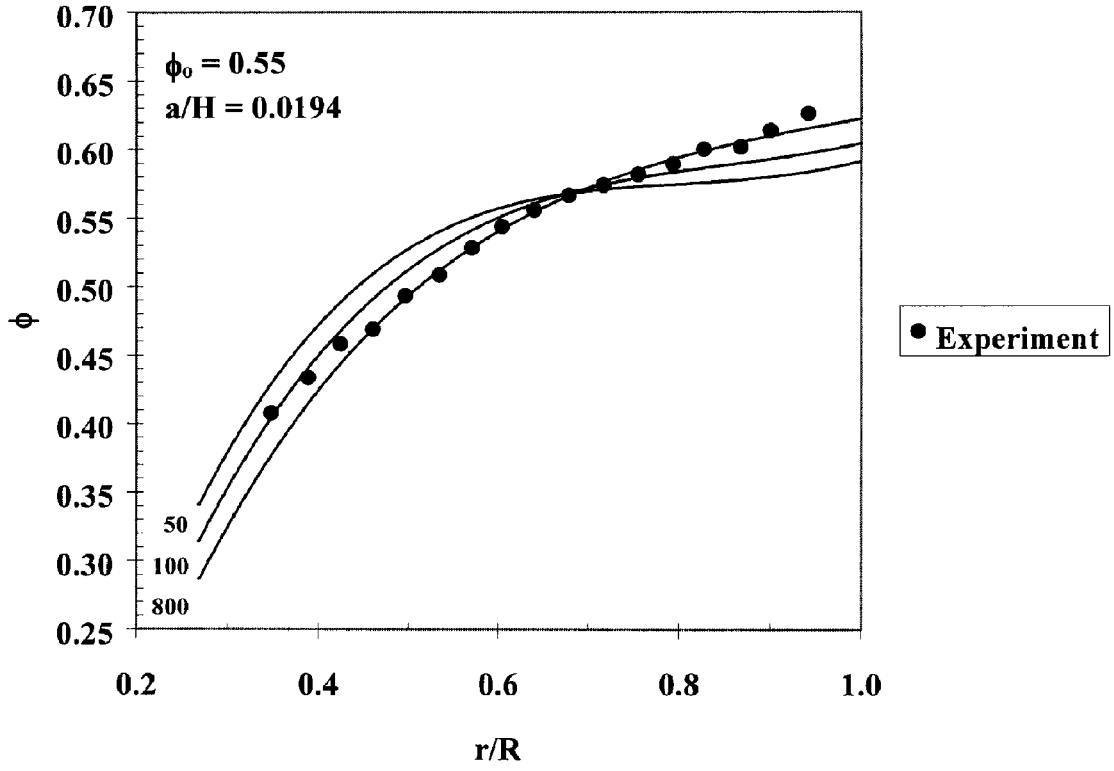
FIG. 4 shows the distributions of particle concentrations in between the rotating inner cylinder and the stationary outer cylinder in wide-gapped Couette flow, as a function of the number of times that the inner cylinder is rotated.

Importantly, the durations to reach these steady state concentration distributions will be a function of the particle radius over the gap ratio. Allende (See, e.g., Allende 2000) calculated the development of the concentration distributions with the number of total rotations of the inner cylinder. As shown in FIG. 3, and with reference now to that Figure, there is shown a graph of concentration distributions for a particle radius over the gap ratio of 0.019 for a concentrated suspension with a volume fraction loading level of 55% of particles by volume. The non-dimensional inner cylinder radius is K=0.27.

For all of the calculations shown herein (FIGS. 3, 4, 8 and 9), the density of the particles matches the density of the liquid phase of the suspension, the particles are unimodal and the binder liquid is Newtonian. Additionally, the experimental results shown pertain to 800 revolutions of the inner cylinder.

These concentration profiles shown in FIGS. 3, 4, 8 and 9 are produced under conditions that involve a processing geometry having the indicated radii and gap over the diameter ratio and for a particle radius over the gap ratio of 0.0194. The volume fraction of the rigid particles would be 55% by volume. Thus, for a mean particle radius of 160 microns the gap would be 8.4 mm.

To achieve significant concentration gradients (hence burn rate gradients) the inner cylinder needs to be rotated substantially 800 times (preferably under conditions that the propellant would not deteriorate and for which the temperature rise would not be significant). Heat transfer means can be provided through the surfaces of the two cylinders to allow the temperature to be kept at the targeted values.

Upon generating the concentration profile by rotating the inner cylinder 800 times, the flow is stopped and the resulting structure is frozen. For a thermosetting binder this involves curing of the propellant—preferably in situ—followed by removing one or more of the cylinders and collecting the remaining propellant slab so produced.

For thermoplastic binders (which melt and solidify upon reaching the melting temperature and upon the temperature being decreased to be less than the melting temperature of the polymer) the cylinders, and hence the propellant formed between the two cylinders, is quenched to again "freeze-in" or otherwise "fix" the concentration gradients that are generated.

Figure 5:
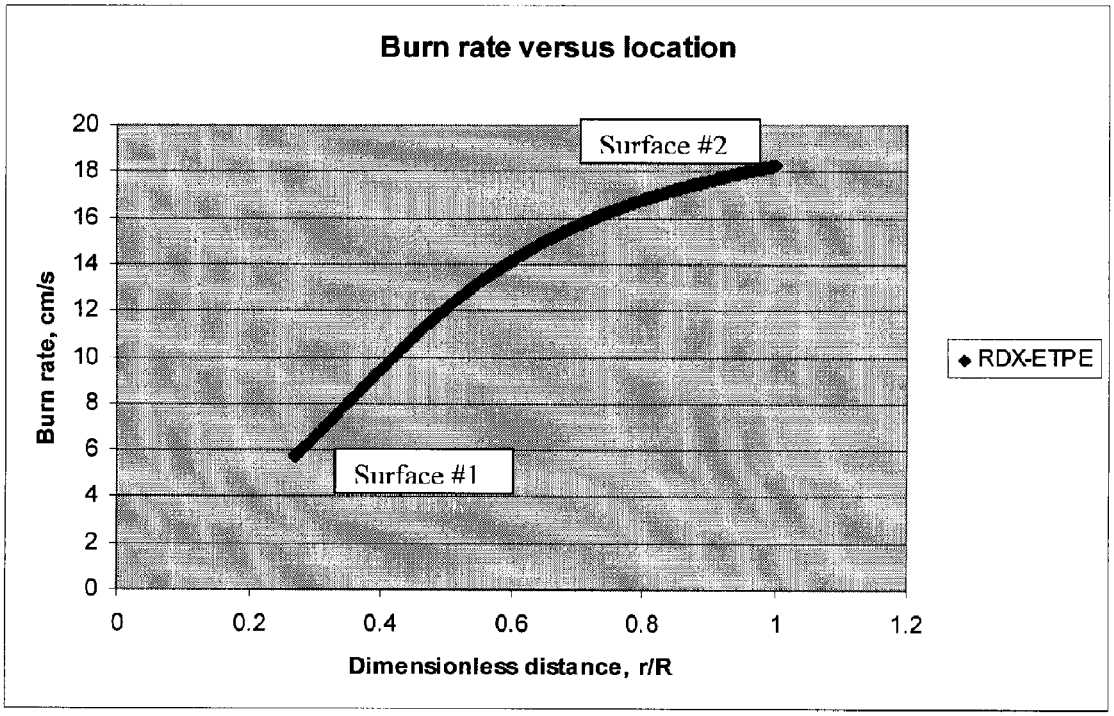
FIG. 5 shows the expected typical burn rate versus radial location in the propellant, recovered from the annular gap between the two cylinders of FIG. 4 upon Couette flow.

Assuming that the burn rate versus the concentration relationship given in Equation 4 prevails under the conditions of a continuously varying concentration distribution and with values of a=50.5, b=−8.5 and c=4 for particles having a particle diameter of 320 microns and fitted from the volume fraction of solids range of 29 to 60% by volume of RDX, the distribution of the burn rates was obtained. The burn rate distributions so obtained are depicted in FIG. 5.

Thus, a slab of energetic propellant having a slab thickness of 8.4 mm (to be recovered upon solidification from the annular space in Couette flow in between the two cylinders shown in FIG. 2, one of which is rotated 800 times) exhibits a high burn rate at one of its surfaces and a lower burn rate at another, opposite surface. These surfaces and their burn rates are shown in the graph of FIG. 5 and are depicted as Surface #1 and Surface #2, respectively.

With the experimental conditions, the length of the energetic propellant grain is equal to the length of the Couette geometry. In addition, the ratio of the burn rates exhibited at the two surfaces is about three, that is the burn rate of the energetic propellant at Surface #2 will be about three times that of the energetic propellant at Surface #1. Advantageously, and as can be appreciated by those skilled in the art, if a lower ratio of burn rates between the energetic propellant at the two surfaces is desired, then the inner (or rotating) cylinder can be rotated an appropriately fewer number of rotations. On the other hand, if a greater ratio of burn rates between the energetic propellant at the two surfaces is desired, one can increase the ratio of the particle radius over the gap thickness in between the two cylinders.

Advantageously, our inventive teachings in which we demonstrate beneficial use of a heretofore undesirable effect, may be performed via alternative experimental and/or manufacturing configurations.

Pressure-Driven Flow Through Die Geometry

Figure 6:
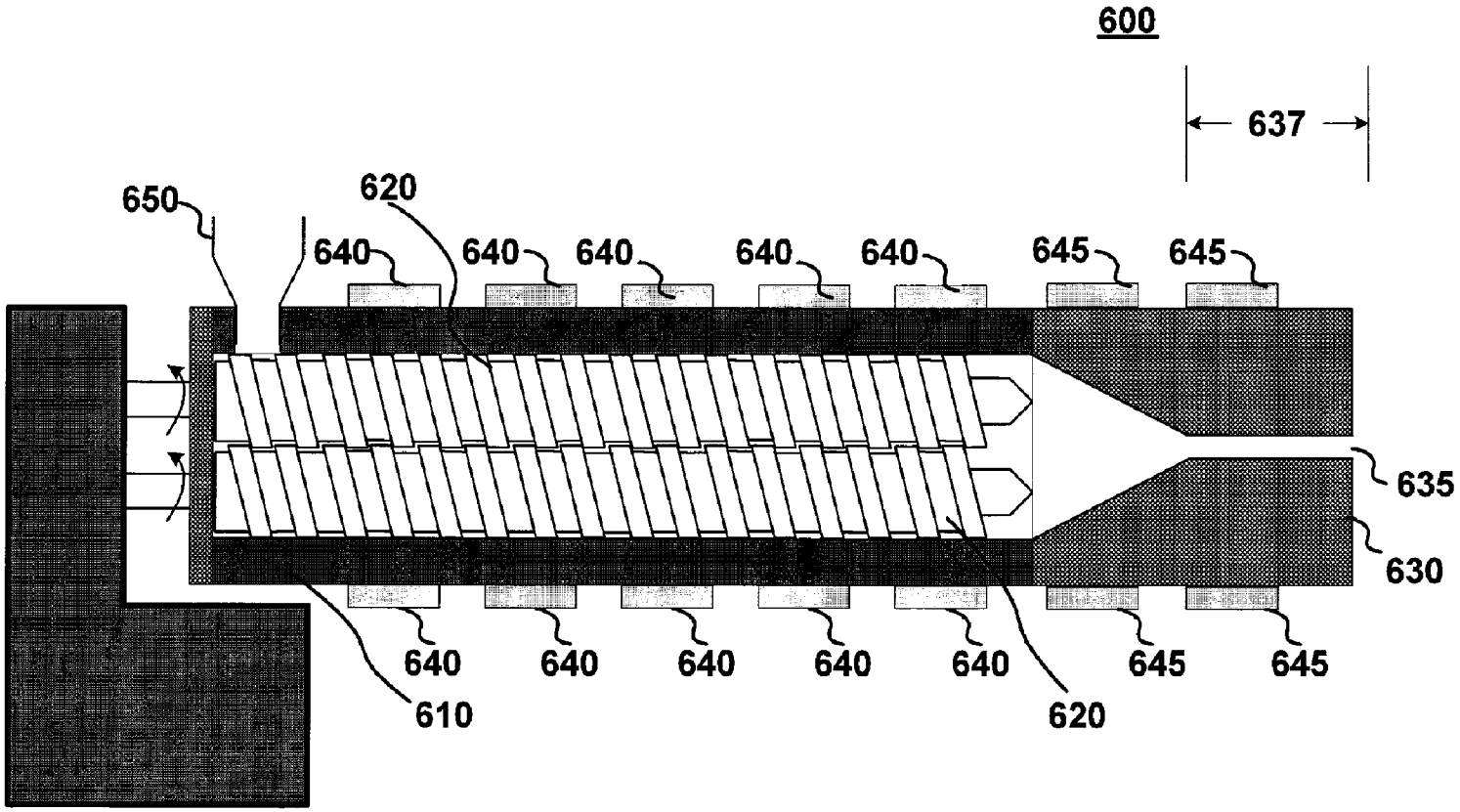
FIG. 6 illustrates a twin screw extruder and a circular die for the formation of a propellant functionally-graded in the radial direction of the extruded strand.

Turning our attention now to FIG. 6, there is shown a cross section of an exemplary extrusion system 600—exhibiting a pressure-driven flow through die geometry—that may be used for the preparation of cross sectional, functionally graded propellants according to our inventive teachings. As can be readily appreciated by those skilled in the art, extrusion methods are widely used in the plastics and other industries as a low cost, efficient, versatile method that provides a continuous, high production volume with many types of raw materials. Disadvantages experienced with other applications such as uniform cross sectional shape and limited complexity of the product, are not disadvantages for our inventive method, however.

With reference to that FIG. 6, the extrusion system 600 includes mixer/extruder body 610 having one or more extruding screws 620 positioned in the body 610. A closed end of the body 610 may include a hopper 650 for introducing material into the extruder 600. Various types of volumetric or loss-in-weight solid or liquid feeders can be also used to introduce various ingredients into the extrusion system.

It should be noted at this point that the exemplary system 600 need not be a "twin-screw" system as depicted in FIG. 6. Other systems including single screw extruders, ram presses, and/or Archimedean pumps will all work satisfactorily with our inventive method in this geometry. As such, our invention is not limited by the particular device/technology that effects the propellant extrusion through a die.

A die 630 is attached to an end of the body such that when material introduced into the system through the hopper 650, it is pumped or pushed toward the die 630 through the action of the screws 620 turning. The die 630 includes a die bore 635 that substantially determines the shape of material extruded. As can be appreciated, the bore 635 may be a variety of shapes, i.e., rectangular, round, other), depending upon the particular application and material. In addition to its characteristic shape and dimensional size, the die bore 635 will have a characteristic length 637.

In operation, the representative extrusion system 600 will receive a quantity of propellant material (not specifically shown) into hopper 650, where it (the material) is engaged by the one or more screws 620, and pumped or pushed toward the die 630 through the action of the turning screws 620. It should be noted, that a system such as the extrusion system 600 shown, is capable of mixing during the extrusion process as well.

In particular, if propellant materials introduced into the hopper were substantially unmixed, individual components, the action of the turning extruding screws 620, combined with selective heating/cooling by heater/cooling units 640, disposed along the body 610 of the extrusion system 600, may advantageously stir and mix the component combination, while maintaining its shaping capability.

As a result, the mixed, propellant material is pushed toward the die where it is forced though die bore 635 along its entire length 637 and subsequently extruded. The extruded propellant material will substantially exhibit the characteristic shape of the die bore 635 and if a thermoplastic binder is used may be finished by cooling and solidification through the action of selective die heating/cooling by die heater/cooling units 645, disposed along the die 630 or upon exit from the die.

As noted before, the action of pumping or pushing the mixed propellant material through the die bore 635, will result in a demixing, in which component particles will migrate toward the center of the die bore 635. Upon this migration the particle concentration at the wall of the die will be smaller than the concentration of particles away from the wall. In this inventive manner, a cross sectional, functionally graded munitions propellant may be extruded from the die bore 635.

Advantageously, varying the length 637 of the die bore 635, as well as its shape and the velocity at which material is extruded there through, different cross sectional, functionally graded characteristics of finished, extruded propellant will result.

As we have noted, there are a number of possible die shapes, sizes, and geometries as well as a variety of pump and/or extrusion systems that will perform satisfactorily with our inventive method. Candidate variations in the die/extrusion systems will likely be predicted from rheological characterization of concentrated suspensions, such as propellant formulations.

Figure 7:
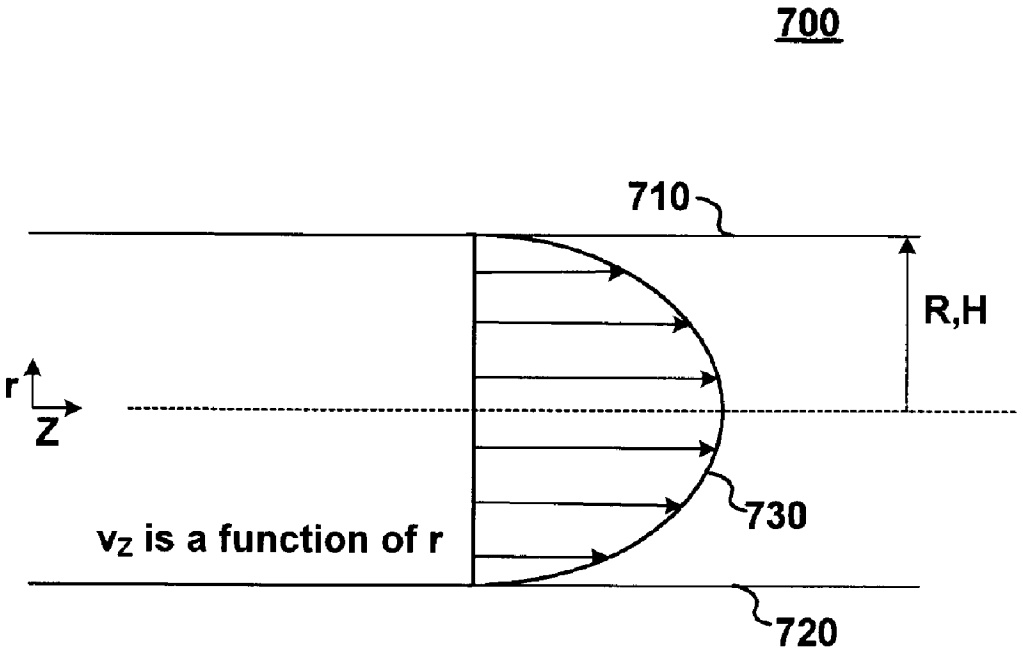
FIG. 7 illustrates the flow through a rectangular slit of gap, H, or a circular tube with radius R.
Figure 8:
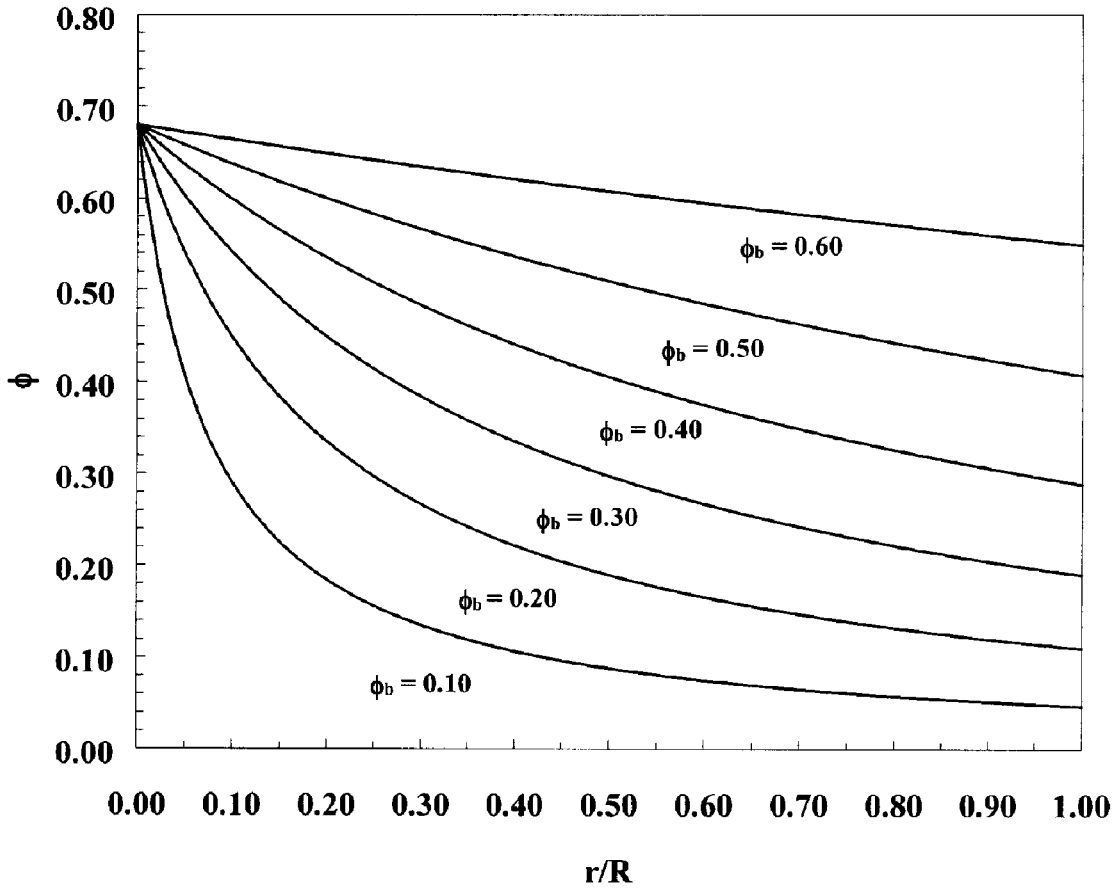
FIG. 8 shows typical fully-developed concentration distributions for flow in a tubular die for different values of initial particle concentrations (by volume)

The pressure-driven flow through the die may be further understood with reference to FIG. 7, in which a schematic geometry and flow 700 in a rectangular slit or circular die are shown. With specific reference now to that FIG. 7, shown therein is a flow 730 proceeding through a rectangular slit having a gap H, or a circular tube having a radius R. The walls of the slit or tube are depicted therein as 710, and 720.

As is known, the equation of conservation of momentum for one-dimensional flow is:

$$-\frac{1}{r^s}\frac{d}{dr}(r^s\tau_{rz}) = \frac{dP}{dz} \tag{7}$$

where r is the transverse direction, z is the axial direction, P is the pressure, $\tau_{rz}$ is the shearing stress and exponent s is zero for rectangular slit die and one for a cylindrical tube. For simplicity, we will use here the solutions for Poiseuille flow (flow through a circular die) with the caveat that the results are also equally valid for one-dimensional rectangular slit flow and other simple shear flows. The conservation of mass requires:

$$V_z\frac{\partial\phi}{\partial z} = \frac{a^2}{r}\frac{\partial}{\partial r}\left\{r\left[K_c\left(\phi^2\frac{\partial\dot{\gamma}}{\partial r} + \dot{\gamma}\phi\frac{\partial\phi}{\partial r}\right) + K_\eta\frac{\dot{\gamma}\phi^2}{\eta_s}\frac{\partial\eta_s}{\partial r}\right]\right\} \tag{8}$$

Equation (8) is solved with the boundary conditions of the total flux being zero at the solid surface, $$K_c\left(\phi^2\frac{\partial\dot{\gamma}}{\partial r} + \dot{\gamma}\phi\frac{\partial\phi}{\partial r}\right) + K_\eta\frac{\dot{\gamma}\phi^2}{\eta_s}\frac{\partial\eta_s}{\partial r} = 0 \tag{9}$$

and the symmetry condition at the axis of symmetry, $$\frac{\partial\phi}{\partial r} = 0. \tag{10}$$

During the flow of suspensions a binder-rich apparent slip layer develops with thickness, δ. If this thickness is stable, the relationship that exists between the wall shear stress and slip velocity (Navier's slip condition) is given by the following expression for a Newtonian binder (for δ<<R):

$$U_s = \frac{\delta}{\eta_o}\tau_w = \beta_{\tau_w} = V_z(R, z) \tag{11}$$

where $\eta_0$ is the shear viscosity of the Newtonian binder and R is the radius of the tubular die. Those skilled in the art will recognize that various techniques are available to determine the Navier's slip coefficient, β, using viscometric flows. (See, e.g., Yilmazer and Kalyon, "Slip Effects In Capillary and Parallel Disk Torsional Flows of Highly Filled Suspensions", J. Rheol. Vol. 33, pp. 1197-1212, 1989; Kalyon et al., ("Rheological Behavior Of A Concentrated Suspension: A Solid Rocket Fuel Simulant", J. Rheol. Vol. 37, pp. 35-53, 1993; and B. K. Aral and D. M. Kalyon, "Effects of Temperature and Surface Roughness On Time-Dependent Development of Wall Slip in Steady Torsional Flow of Concentrated Suspensions", J. Rheol. Vol. 38, pp. 957-972, 1994).

The particle concentration, ϕ, is assumed to be uniform initially:

$$\phi=\phi_0 \text{ for } 0\leqq r\leqq R \text{ at } z=0 \tag{12}$$

The resulting coupled set of Equations (7) and (8) were subsequently solved (see, e.g., Allende 2001 and Krieger 1972) using known, numerical method(s). For example, the steady state distributions of the concentration profiles are given in FIG. 8 for various values of the initial concentration of the solid particles in the range of 10 to 69% by volume. The fully-developed profiles indicate significant depletion of the particle concentration at the wall of the die and significant increase of the concentration of the particles as one approaches the axis of the symmetry. Thus, under such fully developed conditions one would obtain a significant variation of the particle concentration between the wall and the center.

Figure 9:
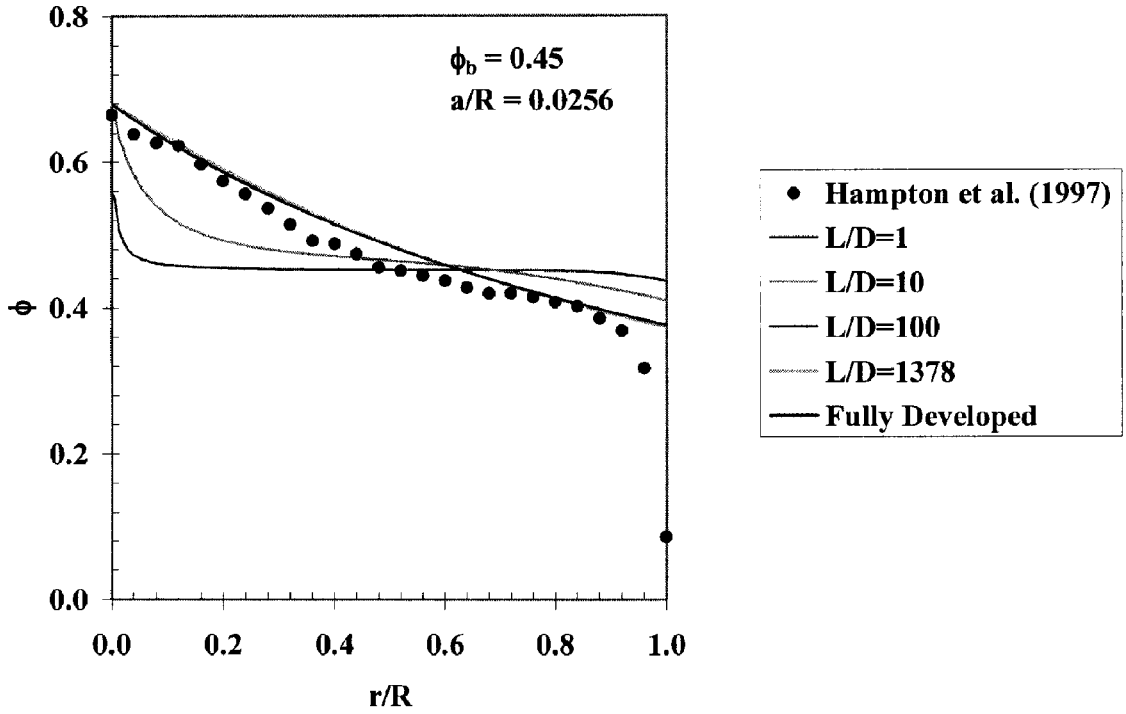
FIG. 9 shows typical particle concentration distributions for a suspension containing 45% by volume solids at various capillary length to diameter ratios.

The typical developments of the concentration distribution in the cylindrical die as a function of the length over the diameter, D, ratio of the die, i.e., L/D, are shown next in FIG. 9. With reference now to that FIG. 9, the initial concentration of the particles is 45% by volume. The ratio of the particle radius to the radius of the tubular die is 0.0256. As the L/D ratio increases the variation of the concentrations across the gap become more pronounced.

Figure 10:
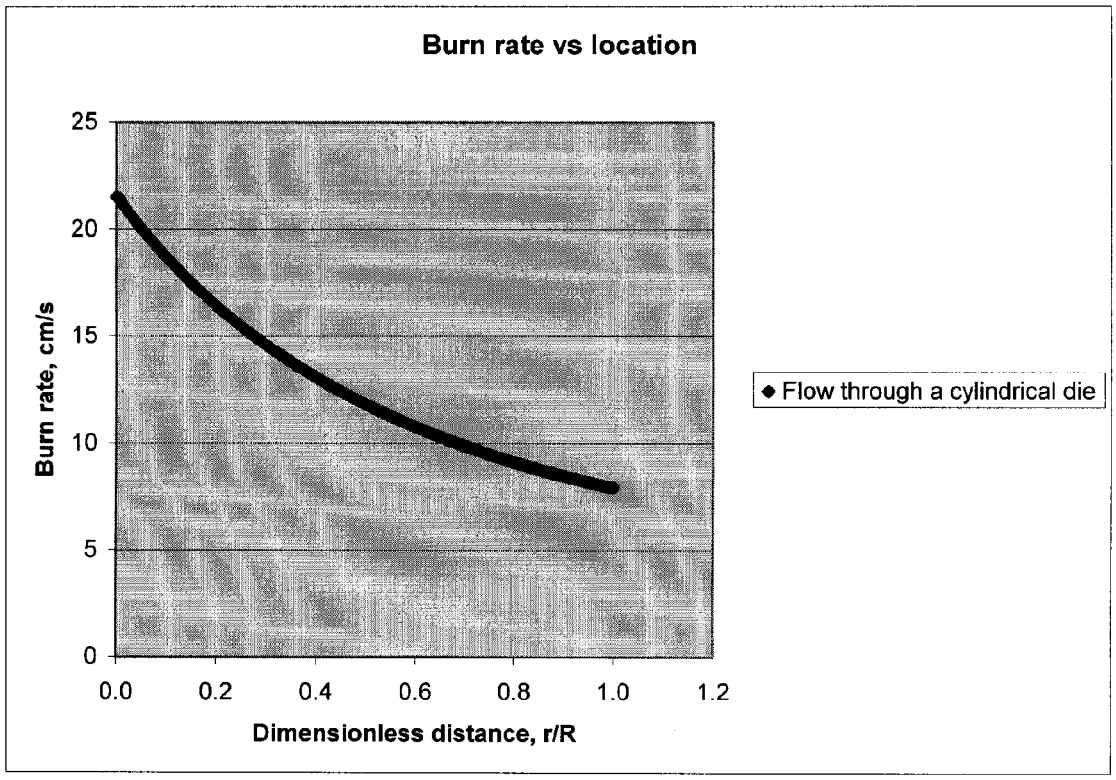
FIG. 10 shows typical burn rate versus location in a cylindrical grain of propellant exposed to flow in a die with a length over the diameter ratio of 100. The particle radius over the die radius is 0.0256. The mean particle diameter is 0.25 mm

Turning now to FIG. 10, if we now assume a geometry having a length over diameter ratio of 100 the concentration at the wall is reduced to 0.37 and the concentration of the particles at the axis of symmetry is 0.68. If the radius of the tubular die is taken as 5 mm, then the total length of the die necessary to achieve this concentration distribution becomes substantially 1000 mm. The diameter of the particles is 0.25 mm (unimodal). Given these data, a burn rate vs. location in a cylindrical grain of propellant exposed to flow in a die is depicted graphically in that FIG. 10.

Continuous Pressure-Driven Flow Through a Die with a Rotating Mandrel and Stationary Bushing Fortunately, our invention and inventive principles are not limited to the exemplary embodiments described so far. In particular, we have developed an alternative geometry, which provides some additional advantages. In particular, with reference to FIG. 11, there is shown a configuration that includes both the time-dependent drag and pressure flow through an annular die in which a mandrel of the die is rotated. The rotation of the mandrel within a stationary outer die body (the bushing) gives rise to the same structuring effect associated with Couette flow in which the suspension is held in between two cylinders one of which is rotating and the other is stationary, as shown and depicted in FIG. 2.

Figure 11:
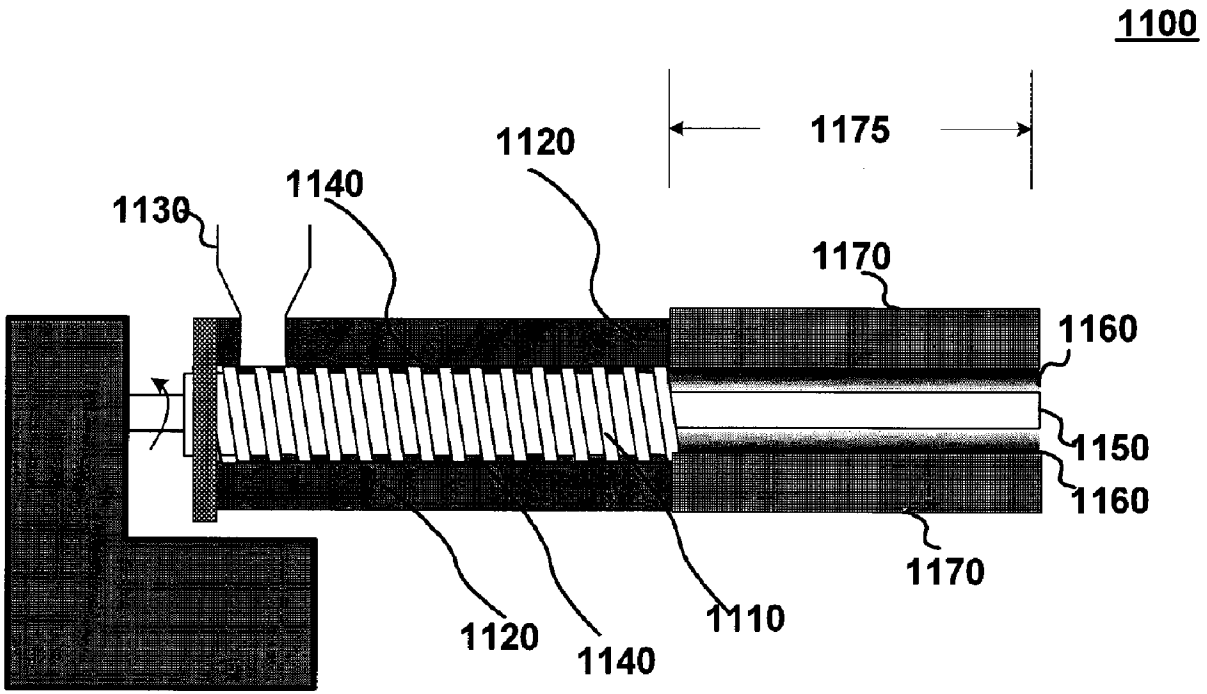
FIG. 11 illustrates a single screw extruder with an annular die comprising a rotating mandrel and a stationary bushing.

Continuing with our discussion of FIG. 11, shown therein is a cutaway, cross-sectional view of an energetic propellant preparation system 1100 that exemplifies this configuration. In particular, energetic material such as a propellant formulation, is fed into the bore of a single screw extruder that generally comprises a screw 1110 disposed axially within extruder barrel 1120.

Through the action of the turning screw 1110, the propellant formulation 1140 is moved along the length of the barrel 1120 into a die body 1175, which includes a stationary bushing 1170 and a rotating mandrel 1150.

As can be seen by inspection of FIG. 11, the rotating mandrel 1150 is shown as a portion of, and rotatably actuated through the rotating action of extruder screw 1110, and when linked in the manner shown, rotates at the same speed as the screw. Those skilled in the art will of course appreciate that this configuration is merely representative of a particular efficient configuration, and that the rotating mandrel 1150 may be turned by alternative mechanism, thereby providing a mandrel 1150 that rotates at a different speed (or even a different direction to) the rotating screw 1110.

The rotating mandrel 1150 is disposed within a generally stationary bushing 1170, and when energetic propellant is disposed therein, it is processed in a manner similar to that within the Couette geometry described earlier. Advantageously, with this extruder/rotating mandrel/stationary bushing geometry shown in FIG. 11, the processed propellant 1160 may be continuously forced out at end of the die body 1175, thereby eliminating the need to disassemble the system and remove the processed propellant 1160.

In practice, the advantages of this configuration becomes more apparent when one considers that after processing in a purely Couette geometry such as depicted in FIG. 2, the processed energetic propellant may require solidification by either cooling (for a thermoplastic binder) or by curing (for a thermosetting binder). The removal of the processed propellant may prove difficult with particular formulations.

As can be appreciated, with the geometry depicted in FIG. 11, it is possible to pump the energetic propellant 1140 into an annular space between the rotating mandrel 1150 and the stationary bushing 1170 of the die body 1175, through the action of a pump (not specifically shown) or an extruder screw 1110 to generate the pressurization of the energetic propellant suspension 1140 to flow into the die at a desired mass flow rate.

Of course, it will be understood by those skilled in the art that various changes may be made to this configuration as necessary or convenient. In particular, heating, or cooling devices may be disposed along the body of the extruder 1120 or die body 1175 to heat/cool the material being processed. Furthermore, the mandrel 1150 need not be interconnected to the extruder screw 1110 but may instead be driven by an independent mechanism. Still further, we have limited our discussion to the situation in which the bushing component 1170 of the die body 1175 remains stationary. Of course, it is within the scope of our inventive teachings that the bushing 1170 may of course turn as well, provided it produces sufficient Couette action for our purposes.

Continuous processing such as that permissible with the configuration depicted in FIG. 11, will allow the generation of functionally-graded propellants on a continuous basis, while still relying on the same particle migration mechanisms and the effectiveness of the earlier described geometries. Of course, the rotation of the mandrel 1150 needs to generate a relatively high deformation rate at its wall to drive rigid particles away from the rotating mandrel 1150 towards the stationary outer wall of the bushing 1170.

As noted before, it is clear that the mandrel 1150 may be rotated at a speed independent of the rotational speed of the extruder screw/s 1110, including the case of rotating mandrel 1150 and stationary screws. Such capability permits the generation of a functionally-graded propellant in a cyclic manner in which the rotational speed of the screw(s) 1110 are reduced to a very low value (or the screw rotation stopped completely), concomitant with the decrease or the stopping of the mass flow rates of the energetic propellant ingredients into the extruder.

The mandrel 1150 is then rotated a sufficient number of times to generate the targeted concentration and hence the burn rate gradients in the transverse direction, followed by the resumption of the pumping action of the extruder screw 1110 or the propellant delivery device to pump, and subsequently completely displace the processed material located in the die body 1175 during the rotation of the mandrel 1150. Of course, the process may be repeated as necessary upon the arrival of new propellant 1140 into the die body 1175.

A natural consequence of using relatively large particles in an energetic formulation is the possible generation of a binder-rich layer adjacent to the wall during processing. The thickness of this apparent slip layer may, as was shown for non-energetic compositions, to be a fraction of the particle size (See, e.g., U. Yilmazer and D. M. Kalyon, "SLIP EFFECTS IN CAPILLARY AND PARALLEL DISK TORSIONAL FLOWS OF HIGHLY FILLED SUSPENSIONS, J. Rheol. Vol. 33, pp. 1197-1212, 1989) suggesting that as the particle size increases the thickness of this binder rich layer may increase. In our application of producing energetic, cross-sectional, functionally graded propellants, this binder rich layer may, in effect form a useful propellant "skin". In turn, this may promote the production of impact-resistant propellants.

Of further interest is that our inventive method should work with a variety of specific propellant formulations. Generally, what is desired in a propellant formulation to be used with our inventive method is a suspension or other mixture of a relatively inert (low energy) binder and relatively active (high energy) solid particles.

Such high energy solids are well known, and in particular cyclotrimethylenetrinitramine (RDX) is a crystalline solid usually found in mixtures of desensitizers or plasticizers, the overall mixture comprising an explosive or propellant. Particularly useful formulations of RDX involve its suspension in a suitable elastomer thereby forming a class of formulations known as thermoplastic elastomers (TPE).

Illustrative examples of typical propellant formulations that should benefit greatly from our inventive method include both the TPE propellants and (LOVA) Low Vulnerability propellants for insensitive munition (IM). Typical formulations representative of these two classes include:

| | LOVA | TPE |
|---|---|---|
| CAB/ATEC | 25-40% | |
| TPE/Plasticizer | | 25-40% |
| Energetic Filler | 50-75% | 50-75% |
| Stabilizer/others | 0-10% | 0-10% |

Additionally, it should be readily appreciated that the Cellulose Acetate Butyrate (CAB) binder may be substituted with any other cellulosic binder material, while Acetyl triethyl citrate (ATEC) may be substituted with other plasticizers. The TPE may be any of a number of known, commercially available TPE materials such as Hytrel. Finally, a variety of known additional components may be included in the formulations such that flash suppression, enhanced handling, stabilization, and/or conductivity characteristics are improved.

What is claimed is:

1. A method of preparing propellants comprising the steps of:

combining, an energetic solid and an inert (low energy) binder into a suspension which does not exhibit a substantial concentration gradient of energetic solid in the bulk suspension and intentionally subjecting the suspension to shear-induced forces, so as to induce creeping flow of the suspension in the absence of inertial effects;

SUCH THAT a sufficient shear-induced particle migration is produced in the suspension resulting in a propellant having a desirable, cross sectional, functional graded characteristic namely a fast burning core and a slower burning outer surface(s) wherein the resulting propellant is one selected from the group consisting of: TPE-based propellant, LOVA propellant.

2. The method according to claim 1 wherein the subjecting step comprises the step(s) of:

extruding the suspension through one or more fixed die(s).

3. The method according to claim 1 wherein the subjecting step comprises the step(s) of:

processing the suspension in an annular space formed between two cylinders wherein at least one of the cylinders is rotating.

4. The method according to claim 3 wherein both of the cylinders are rotating.

5. The method according to claim 1 wherein the subjecting step comprises the step(s) of:

processing the suspension in a die comprising a mandrel and a bushing.

6. The method according to claim 5 wherein the mandrel rotates and the bushing is stationary.

7. The method according to claim 1 wherein the subjecting step further comprises the step(s) of:

pumping the suspension through the effects of a rotating screw extruder.

8. The method according to claim 1 wherein the TPE based propellant comprises: 25-50% TPE/plasticizer, 50-75% energetic filler, and 0-10% other components.

9. The method according to claim 1 wherein the LOVA propellant comprises: 25-40% CAB/ATEC, 50-75% energetic filler, and 0-10% other components.

10. A method of preparing a cross-sectional, functionally graded propellant comprising the steps of:

providing a suspension having energetic solid particles and an inert (low energy) binder which does not exhibit a substantial concentration gradient of energetic solid in the bulk suspension into an annular gap between two cylinders maintained at a desired temperature range; and rotating at least one of the cylinders a sufficient number of times, so as to induce creeping flow of the suspension in the absence of inertial effects, to permit the development of a concentration gradient across the suspension due to shear-induced particle migration thereby resulting in a propellant exhibiting a desirable cross-sectional, functionally graded characteristic namely a fast burning core and a slower burning outer surface wherein the resulting propellant is one selected from the group consisting of: TPE-based propellant, LOVA propellant.

11. The method according to claim 10 further comprising the step(s) of:

solidifying sufficiently the propellant exhibiting the desirable cross-sectional, functionally graded characteristic; and removing the solidified propellant from the annular gap.

12. The method according to claim 10 wherein the TPE based propellant comprises: 25-50% TPE/plasticizer, 50-75% energetic filler, and 0-10% other components.

13. The method according to claim 10 wherein the LOVA propellant comprises: 25-40% CAB/ATEC, 50-75% energetic filler, and 0-10% other components.

14. A method of preparing a cross-sectional, functionally graded munitions propellant comprising the steps of:

introducing an energetic composition comprising a suspension of energetic particles and inert (low energy) binder into a pressurization/delivery device; wherein the energetic composition does not exhibit a significant concentration gradient of energetic particles upon introduction and extruding, through the effect of the pressurization/delivery device, the energetic composition through a length of a die, so as to induce creeping flow of the suspension in the absence of inertial effects, producing a shear induced particle migration such that the extruded composition is the munitions propellant which exhibits a desirable cross-sectional, functionally graded characteristic namely a fast burning core and a slower burning outer surface wherein the propellant is one selected from the group consisting of: TPE-based propellant and LOVA propellant.

15. The method according to claim 14 wherein the die is a circular die.

16. The method according to claim 14 wherein the die is a rectangular, slit die.

17. A method of preparing a munitions propellant comprising a suspension of relatively energetic solid particles in an inert binder, said method comprising the steps of introducing the propellant into a pressurization/delivery device wherein the propellant suspension does not exhibit a significant concentration gradient of energetic particles upon introduction;

pumping, through the effect of the pressurization/delivery device, the propellant into an annular space formed between a mandrel and a bushing; and rotating the mandrel, so as to induce creeping flow of the suspension in the absence of inertial effects, sufficiently to develop a concentration gradient across the propellant such that a resulting particle migration of the energetic solid particles in the binder produces a propellant exhibiting desirable cross-sectional, functionally graded characteristics namely a fast burning core and a slower burning outer surface wherein the propellant is one selected from the group consisting of: TPE-based propellant and LOVA propellant.

18. The method according to claim 17 wherein said pumping is performed continuously.

19. The method according to claim 17 wherein said pumping is performed intermittently.

20. The method according to claim 17 wherein said delivery device is an extruder.

21. The method according to claim 17 wherein the TPE based propellant comprises: 25-50% TPE/plasticizer, 50-75% energetic filler, and 0-10% other components.

22. The method according to claim 17 wherein the LOVA propellant comprises: 25-40% CAB/ATEC, 50-75% energetic filler, and 0-10% other components.

* * * * *